US009409432B2

(12) United States Patent
Meguro et al.

(10) Patent No.: US 9,409,432 B2
(45) Date of Patent: Aug. 9, 2016

(54) MARKING APPARATUS AND COLOR ERASING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Takehiro Meguro, Kanagawa-ken (JP); Hiroshi Ishii, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/823,078

(22) Filed: Aug. 11, 2015

(65) Prior Publication Data

US 2015/0343826 A1 Dec. 3, 2015

Related U.S. Application Data

(62) Division of application No. 14/077,410, filed on Nov. 12, 2013, now Pat. No. 9,132,661.

(51) Int. Cl.
*B41M 7/00* (2006.01)
*B41J 2/32* (2006.01)

(52) U.S. Cl.
CPC ..... *B41M 7/0009* (2013.01); *B41J 2/32* (2013.01); *B41J 2202/37* (2013.01)

(58) Field of Classification Search
CPC ..... B41M 7/00; B41M 7/0009; B41M 7/009; B41J 2/32; B41J 13/14; B41J 11/0095; B41J 11/46
See application file for complete search history.

(56) References Cited

U.S. PATENT DOCUMENTS

| | | | | |
|---|---|---|---|---|
| 6,302,510 | B1 * | 10/2001 | Yoshida | B41J 13/14 347/19 |
| 6,945,721 | B2 * | 9/2005 | Sato | B41J 11/0095 400/61 |
| 7,364,251 | B2 * | 4/2008 | Arakawa | B41J 11/46 347/16 |
| 2004/0080787 | A1 * | 4/2004 | Kakikawa | B41M 7/0009 358/1.18 |
| 2013/0058666 | A1 | 3/2013 | Takahashi | |

* cited by examiner

*Primary Examiner* — Kristal Feggins
(74) *Attorney, Agent, or Firm* — Amin, Turocy & Watson LLP; Gregory Turocy

(57) ABSTRACT

In accordance with an embodiment, the marking apparatus comprises a marking section configured to print, with a color erasable material, a mark in the margin area of a sheet and a marking control section configured to overprint, using the marking section, a mark at a specific position of the sheet every time an image is formed in the image printing area of the sheet with a color erasable material.

10 Claims, 6 Drawing Sheets

MARKING APPARATUS AND COLOR ERASING APPARATUS

CROSS-REFERENCE TO RELATED APPLICATIONS

This application is a Division of application Ser. No. 14/077,410 filed Nov. 12, 2013, the entire contents of all of which are incorporated herein by reference.

FIELD

Embodiments described herein relate to a technology of determining whether or not a reusable sheet on which images are repeatedly formed and erased with a color erasable material is still reusable.

BACKGROUND

A color erasing apparatus is known which is capable of erasing the color of the image on a sheet. A sheet subjected to a color erasing processing by a color erasing apparatus can be repeatedly used in a procedure of forming an image with a color erasable material and erasing the color of the image formed on the sheet.

In the case where an image is formed by an electrophotographic type image forming apparatus, a color erasable material is used as a color erasable toner. The color erasable toner image on a sheet is heated to a temperature higher than the fixing temperature of the toner image, that is, a color erasing temperature, to be color-erased by a color erasing section (heating section). However, even if the color of the color erasable toner image is erased, toner resin is still retained on the sheet as it is.

Thus, toner resin is laminated on a sheet in sequence due to the repeated images formation based on a color erasable toner and the repeated color erasing of coloring toner images. As a result, the laminated toner resin layer gets thicker with the increase of the reuse times of the sheet.

The increase in the thickness of the toner resin layer on a reusable sheet may lead to insufficient heating for a toner image when the color of the coloring toner image is heated and erased by a color erasing section.

DETAILED DESCRIPTION

The marking apparatus according to the embodiment comprises a marking section configured to print, with a color erasable material, a mark in the margin area on a sheet and a marking control section configured to overprint, using the marking section, a mark at a specific position of the sheet every time an image is formed in the image printing area on the sheet with a color erasable material.

Another marking apparatus according to the embodiment comprises a mark reading section configured to read the marks which are printed at non-overlapped positions with each other in the margin area of a sheet to indicate the completion of a color erasing processing before the image printed in the image printing area of the sheet with a color erasable material is subjected to a color erasing processing; a mark count section configured to count the printed marks based on the color difference of the marks calculated using the reading information read by the mark reading section; and a marking section configured to print, with the color erasable material, a new mark in the margin area of the sheet at a position not overlapped with the existing marks indicating the completion of a color erasing processing after the mark reading section reads the mark and before the color of the image in the image printing area of the sheet is erased.

The color erasing apparatus according to the embodiment comprises an image reading section configured to read the image printed in the image printing area of a sheet with a color erasable material and the mark printed in the margin area of the sheet with a color erasable material; a color erasing section configured to erase the colors of the image and the mark printed on the sheet; a reusable sheet retaining section to which a reusable sheet is discharged; a reject sheet retaining section to which a non-reusable sheet is discharged; and a reusability determination section configured to determine whether or not a sheet is reusable based on the color difference of marks calculated using the reading information read by the mark reading section and sort and convey the sheet to the reusable sheet retaining section or the reject sheet retaining section according to the determination result.

The image forming apparatus provided with a marking apparatus and the color erasing apparatus according to the embodiments are described below with reference to accompanying drawings.

(Embodiment 1)

Figure 1:
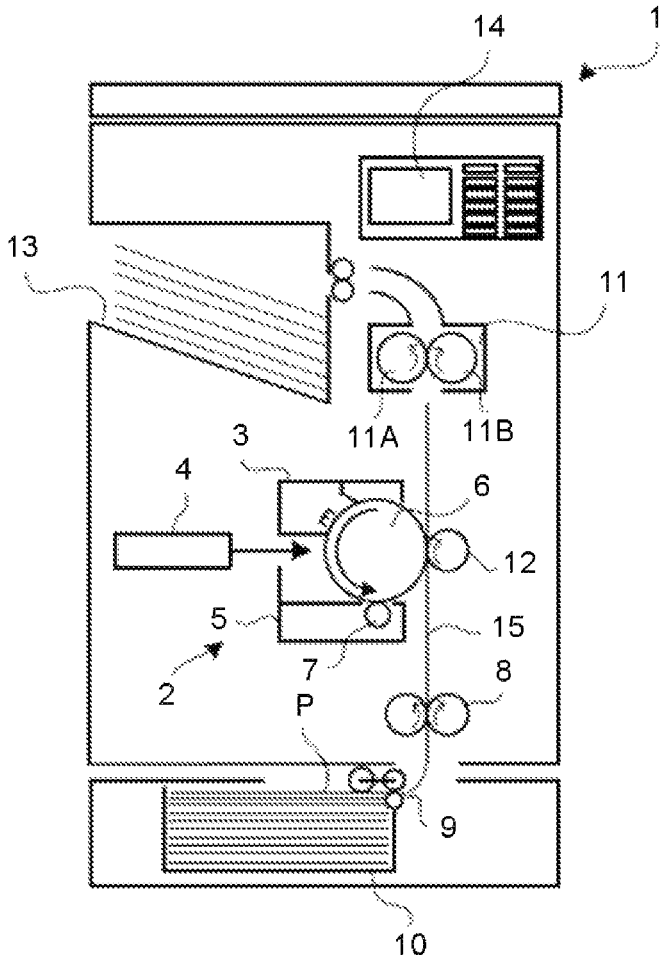
FIG. 1 is a schematic diagram illustrating an image forming apparatus provided with a marking apparatus according to embodiment 1.

FIG. 1 is a schematic front view of an electrophototgraphic type image forming apparatus for forming an image with a color erasable toner in embodiment 1. In FIG. 1, an image forming apparatus 1 comprises a process unit 2 for forming an image. A cleaner unit 3, a laser exposure device 4, a developing device and a transfer roller 12 are arranged around the photoconductive drum 6 of the process unit 2. The cleaner unit 3 comprises a cleaning blade for removing the toner left on the surface of the photoconductive drum 6, a charge removing lamp for removing the charges of the charged photoconductive drum 6 and a charger for charging the photoconductive drum 6 again. The photoconductive drum 6 is exposed by the exposure light from the laser exposure device 4 to form an electrostatic latent image.

The developing device 5 houses color erasable toner as a developer, and develops the electrostatic latent image formed on the photoconductive drum 6 using the color erasable toner through the developing roller 7 to form an toner image After the start button on an operation panel 14 is set to be ON to carry out a printing instruction, the sheet P in a paper feed cassette 10 is started to be conveyed towards the conveyance path 15 by the paper feed roller 9, and finally conveyed to a resist roller 8. Then, with the starting of the conveying of the resist roller 8, the sheet P is conveyed to the nip position (transfer position) between the transfer roller 12 and the photoconductive drum 6 by matching the position of toner image on the photoconductive drum 6 with the timing. An unfixed toner image on the photoconductive drum 6 is transferred onto the sheet P at the transfer position. In a fixer 11, when a sheet P carrying an unfixed toner image passes through the nip part between a heat roller 11A and a pressure roller 11B, the unfixed toner image is heated and pressed to fix the sheet P. Then, the fixed sheet P is discharged to a paper discharging tray 13.

Figure 3:
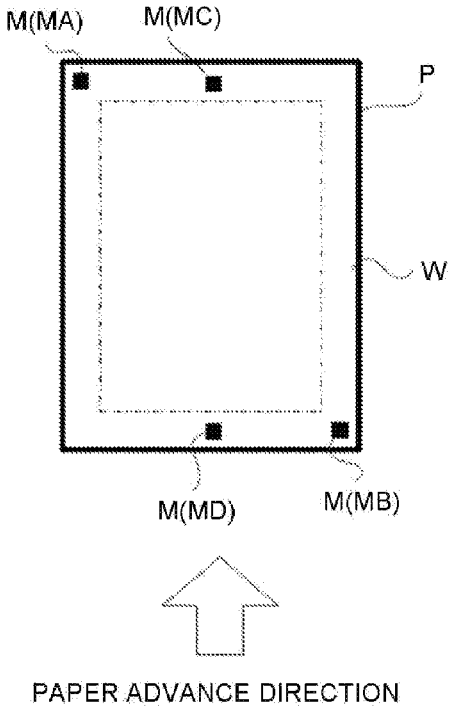
FIG. 3 is a diagram illustrating a marking state based on the marking apparatus shown in FIG. 2.

In the embodiment, the image forming apparatus 1 is provided with a marking apparatus 20 which will be described later and which prints marks M representing reuse times with a color erasable material in the margin area W of a sheet P, as shown in FIG. 3. The marking apparatus overprints marks Mat specific positions using an image forming process unit 2. In FIG. 3, in the four corners of a sheet, marks M are marked at two diagonal points of a diagonal line. The two marks M at the two points are represented by MA and MB. When a sheet P is stored in the paper cassette 10, sometimes the side of the sheet having the first mark MA or the second mark MB is taken as a front end side. However, by printing marks M at two points of a diagonal line, the marks M are overprinted on the first mark MA and the second mark MB respectively for each printing, regardless of the orientation of the sheet P. Further, the printing operation carried out when the second surface of the sheet P is taken as a front surface is the same as that carried out when the first surface of the sheet P is taken as a front surface.

Therefore, a plurality of marks M become laminated on the first mark MA and the second mark MB through repeated printing and color erasing operation. For example, three layers of marks M are printed on the first mark MA and the second mark MB on the first surface if the first surface serving as a front surface is printed for three times. Further, one layer of mark M is printed on the first mark MA and the second mark MB on the second surface if the second surface serving as a front surface is printed once. In this case, the total number of layers of the marks M on the first and the second surface is 4.

Figure 2:
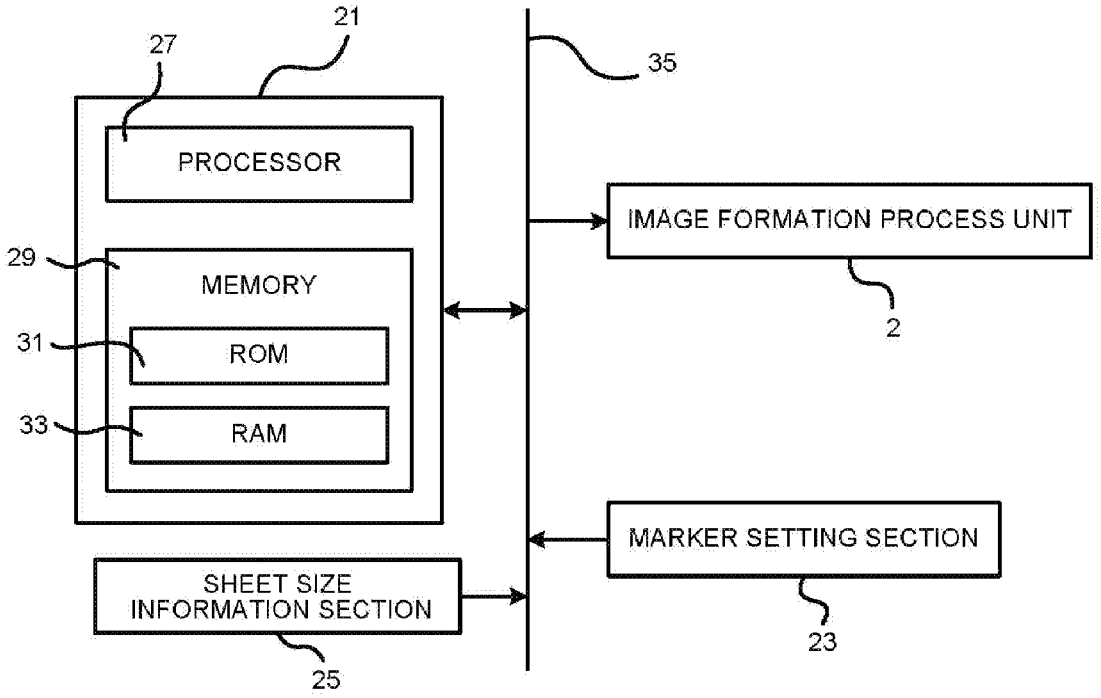
FIG. 2 is a control block diagram of the marking apparatus shown in FIG. 1.

FIG. 2 is a block diagram illustrating the hardware configurations of the marking apparatus 20. The marking apparatus 20 comprises a control section 21, a marker setting section 23 and a sheet size information section 25.

The control section 21 has a processor 27 consisting of, a CPU (Central Processing Unit) or an MPU (Micro Processing Unit) and a memory 29. The control section 21 controls the marker setting section 23 to drive the laser exposure device 4 of the process unit 2 for printing marks M in the margin area W of the sheet shown in FIG. 3. In this case, the control section 21 acquires the size (e.g. A4 or A3, etc.) of the sheet from the sheet size information section 25 and controls the marker setting section 23 to print marks M at four diagonal corners of the sheet P matching with the acquired sheet size.

The memory 29, which is, for example, a semiconductor memory, has a ROM (Read Only Memory) 31 for storing various control programs and a RAM (Random Access Memory) 33 for providing a temporary work area for the processor 27. For example, the ROM 31 stores printing positions of marks M corresponding to various sheet sizes as well as the sizes, the shapes and the concentrations of the marks. The components of the marking apparatus 20 are connected with each other through a bus 35.

In the embodiment, with the color erasing apparatus 100 shown in FIG. 4 which will be described later, the image on the sheet P shown in FIG. 3 is erased, at the same time the colors of the first mark MA and the second mark MB are heated to be erased. Moreover, the colors of the first mark MA formed on the first surface and the second mark MB formed on the second surface are erased synchronously.

In the color-erased first mark MA or second mark MB, there is a color difference ⊿E between a ground color of the medium, that is, in the use of a white sheet, the white part of the white sheet, and the part where there is an erasing residual left. Here, the color difference of the first mark MA or the second mark MB on the first surface is set to be ⊿E1, and that of the first mark MA or the second mark MB on the second surface is set to be ⊿E2. Then, the total color difference of the two surfaces is set to be ⊿E, and then it becomes ⊿E=⊿E1+⊿E2.

Figure 6:
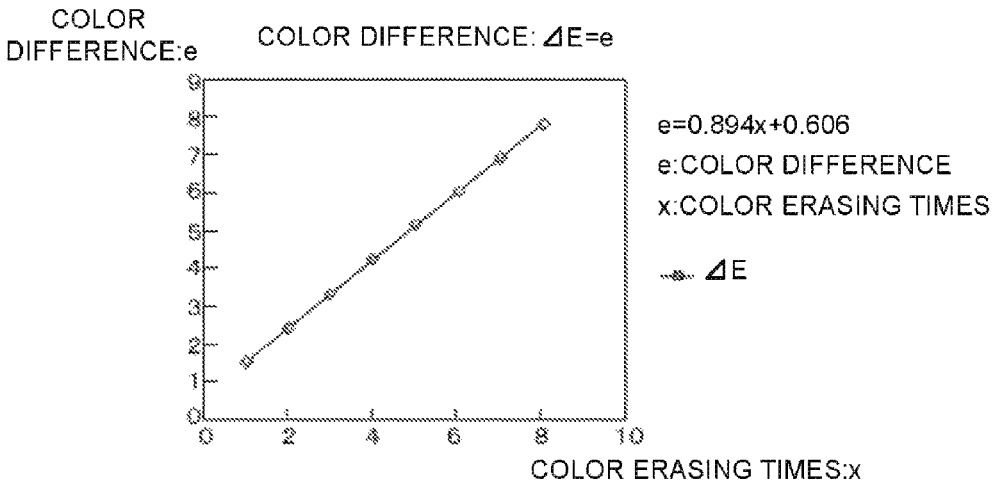
FIG. 6 is a diagram illustrating the relationship between a color difference and a color erasing times.

Toner resin gets thicker with the increase of the number of the laminated first marks MA or second marks MB, as a consequence, it is hard to transfer heat even if the first marks MA or the second marks MB are heated to be color-erased. Moreover, it is also hard to transfer heat even if a resin layer is formed on either or both of the first and second surfaces. Further, the color difference (⊿E) increases with the thickness of the resin layer increased. FIG. 6 illustrates the relationship between the color difference and a color erasing times.

In the embodiment, the color difference is calculated and whether or not the color erasing times corresponding to the calculated color difference exceeds a specific color erasing times is determined every time a color erasing processing is carried out, the sheet is determined to be non-reusable if it is determined that the specific color erasing times is exceeded, and then the sheet is fed to a reject cassette.

Further, although the first marks MA and the second marks MB are formed at four diagonal corners, as shown in FIG. 3, marks can be formed on the front surface and the back surface of a sheet if marks MC and MD are formed at the center positions in the width direction of the sheet. In this case, in addition to a method for determining whether or not a sheet is reusable by summing color differences of all marks, a method is also available which calculates a maximum value of color difference according to the color difference of the erased marks on the front surface and the back surface of the sheet and carries out a determination such as determining the sheet is non-reusable when the maximum color difference value exceeds a given reference value. Further, marks M may also be formed at four corners of a sheet. Anyway, as long as marks can be overprinted for each printing (color erasing), regardless of the orientation of the sheet P in the conveyance direction.

Next, the configuration of the color erasing apparatus (erasing apparatus) according to the embodiment is described with reference to FIG. 4.

The color erasing apparatus 100 carries out a color erasing processing (erasing processing) of erasing the color of an image formed with a color erasable material for a sheet on which the image is formed with the color erasable material (erasable color material) such as a color erasable toner or color erasable ink and the like. The color erasable material contains a color generation compound, a color developing agent and a color erasing agent. The color generation compound is, for example, a leuco dye. The color developing agent is, for example, phenols. The color erasing agent is, for example, a material which is dissolved with the color generation compound when heated and has no affinity with the color developing agent. The color erasable material develops the color by the interaction of the color generation compound and the color developing agent is color-erased by the heating above a temperature higher than a color erasing temperature, the color erasable material is subjected to the color erasing.

Moreover, the color erasing temperature is a high temperature higher than a fixing temperature.

The color erasing apparatus 100 comprises a paper feed tray 102, a paper feed component 104, a reading section 106 for reading a first surface and a second surface of a sheet P, a color erasing section 108, a first tray 110 for feeding a reusable sheet and a second tray 112 for feeding a reject sheet. Further, the color erasing apparatus 100 comprises a first conveyance path 114 for conveying a sheet from the sheet feed tray 102 to the second tray 112; a second conveyance path 120 connected with the first conveyance path 114 at a first bifurcating point 116 and a mergence point 118; and a third conveyance path 124 which bifurcates away from the first conveyance path 114 at a second bifurcating point 122 to feed a sheet to the first tray 110. The second conveyance path 120 conveys the sheet conveyed from the first bifurcating point 116 towards the mergence point 118.

Further, a first reverse gate 126 serving as a first bifurcating component is configured at the first bifurcating point 116, the sheet conveyed on the first conveyance path 114 is still conveyed on the first conveyance path 114 if the first reverse gate 126 is in the OFF state, and the sheet is conveyed towards the second conveyance path 120 if the first reverse gate 126 is switched (reversed) to the ON state shown by the dotted line. A second reverse gate 128 serving as a second bifurcating component is configured at the second bifurcating point 122, and the sheet conveyed on the second conveyance path 114 is still conveyed on the first conveyance path 114 when the second reverse gate 128 is in the OFF state to be fed to the second tray 112 when the second reverse gate 128 is in the OFF state. Further, if the second reverse gate 128 is switched (reversed) to the ON state shown by the dotted line, then the sheet is conveyed towards the third conveyance path 124 to be fed to the first tray 110.

The paper feed tray 102 stacks sheets for reuse, the size of which are various, may be A4, A3, B5 and the like. The sheet stacked on the paper feed tray 102 is a sheet on which an image is formed with a recording medium the color of which is erased when heated to a temperature above a given temperature. The paper feed component 104 comprises a pickup roller, a sheet feed roller and a separation roller arranged opposite to the sheet feed roller; sheets are successively fed to the first conveyance path 114 inside the color erasing apparatus 100 from the sheet at the highest position stacked on the paper feed tray 102.

Further, the paper feed tray 102 is provided with a detection sensor 130 (hereinafter referred to as paper feed starting detection sensor) for detecting whether or not there is a sheet on the paper feed tray 102. The paper feed starting detection sensor 130, which is, for example, a micro sensor or a micro actuator, feeds a stacked sheet according to a set paper feeding mode when detecting the stacking of the sheet. A paper feed control based on a control section 200 which will be described later will be described later.

The first conveyance path 114 constituting a conveyance path from the paper feed tray 102 to the second tray 112 conveys a fed sheet to the reading section 106.

The reading section 106 is arranged along the first conveyance path 114 which is located at the downstream of a sheet conveyance direction with respect to the paper feed tray 102. The reading section 106 is provided with a reading unit such as a CCD (Charge Coupled Device) scanner or a CMOS sensor. In the embodiment, the reading section 106 respectively reads the images on the first and the second surface of a conveyed sheet. That is, the reading section 106 consists of a first reading unit 1061 and a second reading unit 1062 which is arranged across and along the first conveyance path 114, thereby reading the images on two sides of a conveyed sheet.

The position where the reading unit of the reading section 106 reads an image of a sheet is referred to as a reading position. The image read by the reading section 106 is stored in a storage section 210 (refer to FIG. 5) which will be described later. For example, the image read by the reading section 106 on a sheet is computerized and stored in the storage section 210 before a color erasing processing so that image data can be obtained later when the data of an color-erased image is needed. Further, the control section 200 which will be described later determines whether or not a sheet is a color erasable sheet or a reusable sheet based on the image read by the reading section 106.

The first reverse gate 126 is arranged at the downstream of the reading section 106 as a switching section. The first reverse gate 126 switches the conveyance direction of a conveyed sheet. The first reverse gate 126 conveys the sheet conveyed on the first conveyance path 114 to the second conveyance path 120 or the second tray 112. The second conveyance path 120 bifurcates away from the first conveyance path 114 at the bifurcating point 116 where the first reverse gate 126 is arranged. The second conveyance path 120 bifurcated away from the bifurcating point 116 conveys a sheet to the color erasing section 108.

Further, the second conveyance path 120 merges with the first conveyance path 114 at the mergence point 118 at the upstream of the sheet conveyance direction of the reading section 106. That is, the second conveyance path 120 merges with the first conveyance path 114 at the mergence point 118 between the paper feed tray 102 and the reading section 106. Thus, the second conveyance path 120 is capable of conveying the sheet conveyed from the reading section 106 to the reading section 106 again after conveying the sheet through the color erasing section 108. In other words, the color erasing apparatus 100 controls (ON, OFF) the first reverse gate 126 to convey the sheet fed from the paper feed component 104 orderly to the reading section 106, the color erasing section 108 and the reading section 106.

The first conveyance path 114 has the second reverse gate 128 at the downstream of the first reverse gate 126. The second reverse gate 128 which conveys the sheet to the first tray 110 guides the sheet conveyed from the first reverse gate 126 to the second tray 112 or the third conveyance path 124.

The color erasing section 108 erases the color of the image on the conveyed sheet. For example, the color erasing section 108 heats the conveyed sheet to a specific color erasing temperature in such a state that the color erasing section 108 contacts the conveyed sheet, thereby erasing the color of the image formed on the sheet with a color erasable material. For example, the color erasing section 108 of the color erasing apparatus 100 described herein comprises a color erasing unit 1081 for the first surface of a sheet and a color erasing unit 1082 for the second surface of a sheet.

The color erasing unit 1081 and the color erasing unit 1082 are arranged opposite to each other across the second conveyance path 120. The color erasing unit 1081 contacts and heats a sheet from one surface side of the sheet. The color erasing unit 1082 contacts and heats the sheet from the other surface side of the sheet. The color erasing section 108 comprises temperature sensors 1091 and 1092 for detecting temperatures of heating sections of the color erasing unit 1081 and the color erasing unit 1082, respectively. The temperature sensors 1091 and 1092 are a contact type or non-contact type.

The operation section 129 arranged on the main body of the color erasing apparatus 100 comprises a touch panel type display section and various operation keys, which are located, for example, on the upper portion of the main body of the color erasing apparatus. The operation keys include numeric keys, a stop key and a start key.

In the embodiment, the sheets stacked on the paper feed tray 102 are fed according to a set paper feeding mode which will be described later. In addition to a setting operation for the paper feeding mode with the operation section 129, the user instructs functional actions of the color erasing apparatus such as starting an color erasing operation or reading image on a sheet to be color erased. The operation section 129 displays the set information, the operation status and the log information of the color erasing apparatus 100 or a message to the user.

Further, the operation section 129, which is not limited to be arranged on the main body of the color erasing apparatus 100, may further be a configuration which can be operable according to the operation section of an external apparatus connected with the color erasing apparatus 100 via a network. Alternatively, the operation section may be independent from the main body of the color erasing apparatus to operate the color erasing apparatus 100 through wired or wireless communication. The operation section described herein may be any operation section that is capable of giving a processing instruction or information browsing to the color erasing apparatus 100.

Discharging rollers 101 and 103 discharge a sheet to the first tray 110 and the second tray 112 which are arranged up and down on the main body. For example, the first tray 110 stacks a sheet which can be reused after the color of the image on the sheet is erased. The second tray 112 stacks a sheet which is determined to be non-reusable. The first tray 110 is referred hereinafter to as a reuse tray and the second tray 112 a reject tray. Further, the reuse tray 110 and the reject tray 112 are capable of changing the sheets serving as receiving object.

The color erasing apparatus 100 comprises a plurality of sheet detection sensors 131 for detecting the sheets conveyed on the first to the third conveyance path 114, 120 and 124. The sheet detection sensors, which may be, for example, micro sensors or micro actuators, are arranged at proper positions of the conveyance paths. Further, a conveyance roller 132 is arranged at a proper position of a conveyance path.

Figure 5:
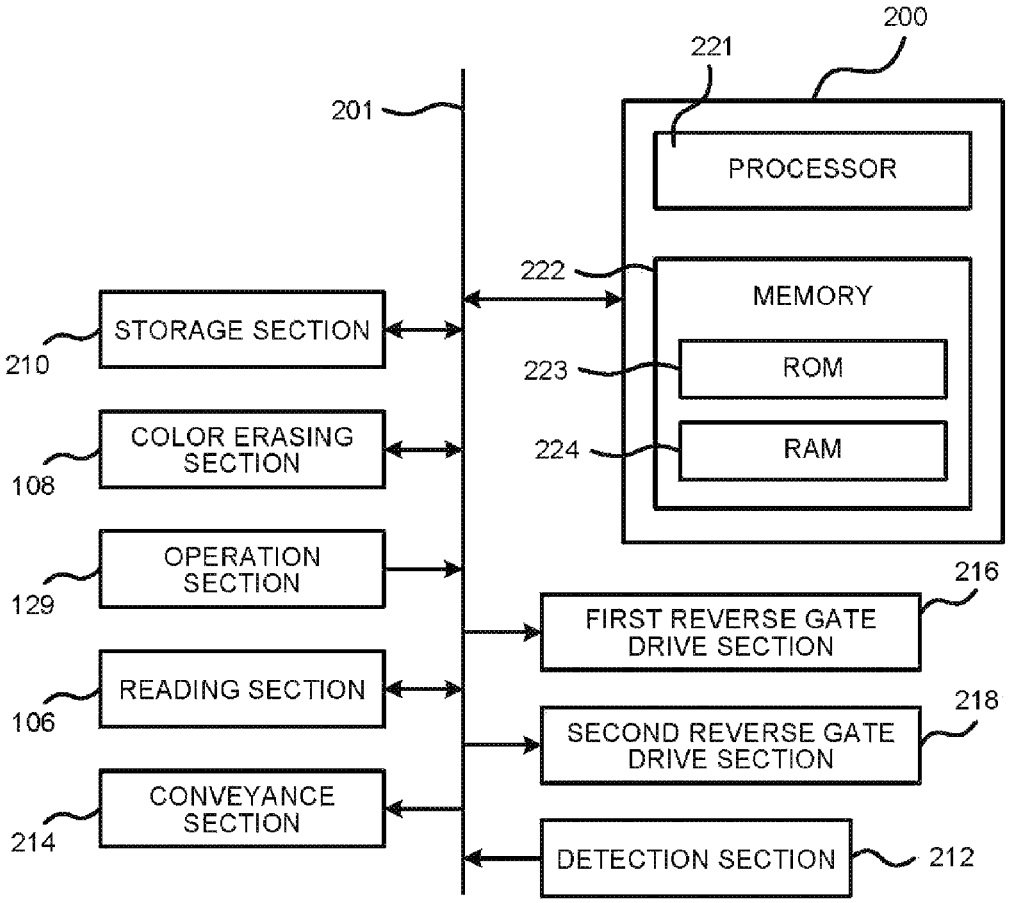
FIG. 5 is a control block diagram of the color erasing apparatus shown in FIG. 4.

FIG. 5 is a block diagram illustrating the hardware configuration of the color erasing apparatus 100. The color erasing apparatus 100 comprises the control section 200, the storage section 210, a detection section 212 provided with the detection sensor 103, a conveyance section 214 provided with the paper feed component 104, the reading section 106, the color erasing section 108, the operation section 129, a first reverse gate drive section 216 and a second reverse gate drive section 218, which are connected with each other through a bus 201.

The control section 200 has a processor 221 consisting of, for example, a CPU (Central Processing Unit) or an MPU (Micro Processing Unit) and a memory 222. The control section 200 comprises the reading section 106, the color erasing section 108, the operation section 129, the conveyance section 214, the first reverse gate drive section 216 and the second reverse gate drive section 218.

The memory 222, which is, for example, a semiconductor memory, has a ROM (Read Only Memory) 223 for storing various control programs and a RAM (Random Access Memory) 224 for providing a temporary work area for the processor 221. For example, the ROM 223 stores a paper printing rate serving as a threshold value for determining whether or not a sheet is reusable and a concentration threshold value for determining whether or not the color of an image is erased. Further, the ROM 223 stores a formula for calculating the color difference ⊿E1 of a color-erased mark M read by the reading section 106 for the first surface of a sheet and the color difference ⊿E2 of a color-erased mark M read by the reading section 106 for the second surface of the sheet, a formula for calculating the total color difference ⊿E (⊿E=⊿E1+⊿E2) of the first surface and the second surface according to the summation of the first color difference ⊿E1 and the second color difference ⊿E2, the relational expression shown in FIG. 6 expressing the relationship between the total color difference ⊿E and a color erasing times, a using limit color difference (e) and the like.

Here, the marks Non the first surface and the second surface are read by the reading section 106 after a color erasing processing. A color difference based on the overlapping of marks M represents the color difference between a part which is color-erased to be a white color (where the ground color of a sheet P can be observed through a resin layer) and a part where an erasing residual left occurs. The color difference ⊿E*a b in a L*a*b*color system is calculated by calculating the square root of the sum of the squared values of the difference in two colors of L*, a* and b*, as shown in the following formula:

$$\Delta E^*a\ b=\{(\Delta L^*)2+(\Delta a^*)2+(\Delta b^*)2\}^{1/2}$$

In the relationship between a color erasing times and a color difference ⊿E shown in FIG. 6, the value of y (y=a·x+b) which is calculated in advance using a color erasable toner is taken as the color difference ⊿E. Here, x represents a color erasing times, and a and b are coefficients. Further, e serves as a using limit color difference which is set in the color erasing apparatus after being calculated through y. Thus, when the value of the ⊿E exceeds e, the processor 221 determines the color erasing times exceeds the specific color erasing times of a sheet and conveys the sheet P to the reject tray 112. Further, in the graph shown in FIG. 6, e=0.894x+0.606.

In a reading processing, the control section 200 stores the image (image) read by the reading section 106 from the first sheet P conveyed to the reading section 106 in the storage section 210 (refer to FIG. 5). Then, the sheet P first passing through the reading section 106 is conveyed to the second conveyance path 120 and then subjected to a color erasing processing. In the color erasing processing, the control section 200 erases the image on the sheet using the color erasing section 108. The sheet P after a color erasing processing is conveyed to the reading section 106 again, then a determination on whether or not it is color erasable is made, and a sorting processing is carried out based on the determination result.

In the sorting processing, apart from carrying out a sorting processing based on the color difference of the aforementioned mark M, the control section 200 further determines whether or not the sheet is reusable based on the image read by the reading section 106. For example, in the sorting processing, the control section 200 determines whether or not there is an image on the sheet based on the data read by the reading section 106 and determines the sheet is not reusable if there is an image. For example, when a sheet subjected to a color erasing processing is read by the color erasing section 108, if there is a residual image that is not erased, then the control section 200 determines that the sheet is not reusable as there is an erasing residual left. Further, in the sorting processing, the control section 200 determines the corrugation depth and whether or not there is a fracture or breakage based on the data read by the reading section 106. If the corrugation depth is greater than a given value or there is a fracture, breakage or hole, the color erasing apparatus 100 determines the sheet to be non-reusable.

That is, the color erasing section 108 reads the image on a sheet using the reading section 106 before erasing the color of the image on the sheet, and the reading section 106 reads the image on the color-erased sheet after the color erasing section 108 erases the color of the image on the sheet.

The storage section 210 stores application programs and an OS. The application programs include programs for executing the functions of the color erasing apparatus, such as the reading function of the reading section 106 and the color erasing function of the erasing section. The application programs further include an application (Web browser) for Web clients and other applications. The storage section 210 stores the image read by the reading section 106. Further, the storage section 210 stores the number of the sheets processed by the color erasing apparatus 100. The storage section 210 may be a hard disc drive or other semiconductor storage device such as a magnetic storage device, an optical storage device or a flash memory, or any combination thereof.

Figure 7:
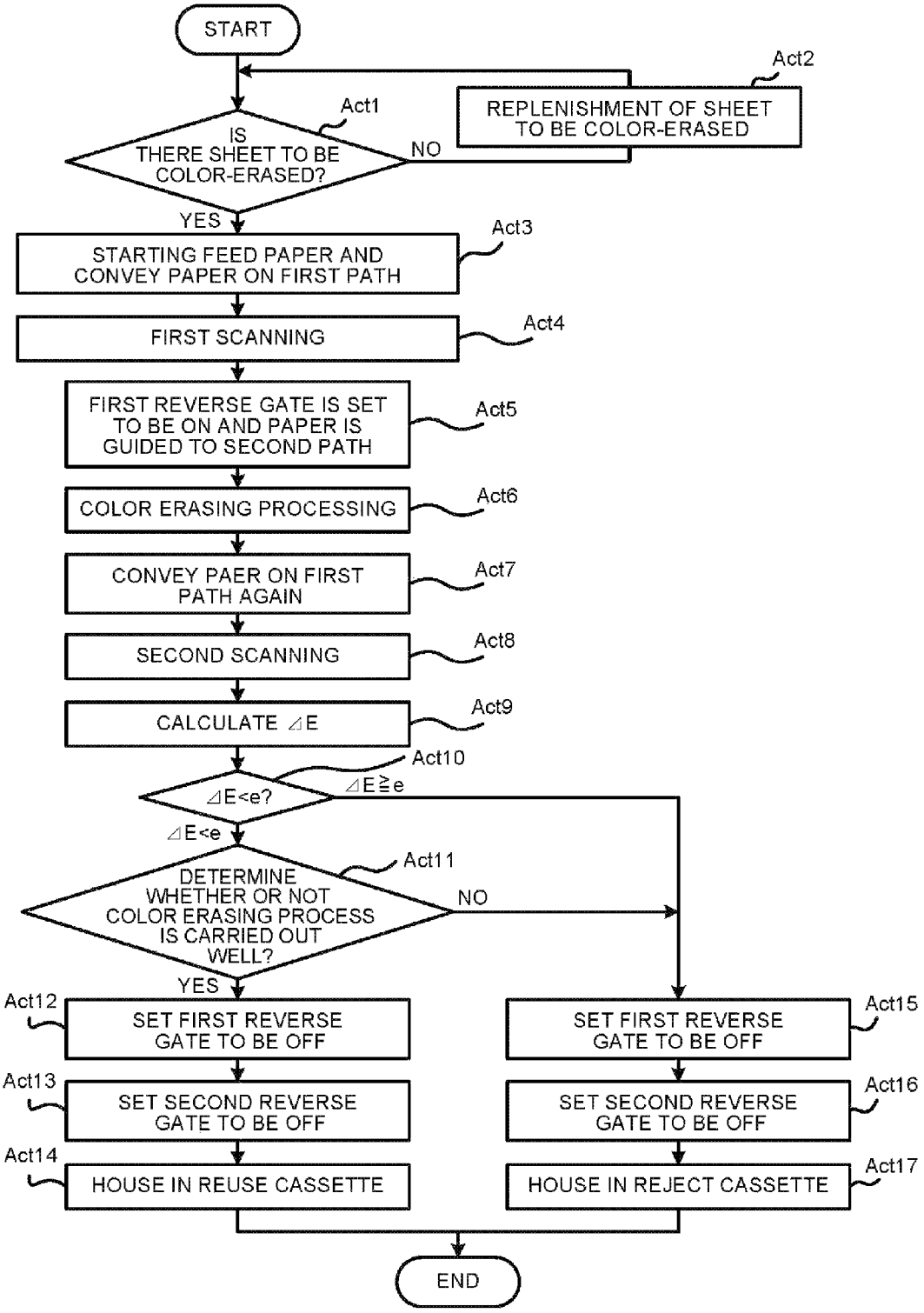
FIG. 7 is a flowchart illustrating the operations of the color erasing apparatus shown in FIG. 4.

The flow of the sorting processing carried out according to the color erasing apparatus 100 is described below with reference to FIG. 7.

In Act 1, whether or not there is a sheet to be color-erased is determined, if there is such a sheet, the flow proceeds to Act 3, otherwise, the flow proceeds to Act 2 to wait for the replenishment of a sheet to be color-erased, and then the flow proceeds to Act 3.

In Act 3, the sheet P to be color-erased is fed and conveyed on the first conveyance path 114, and then the flow proceeds to Act 4.

In Act 4, the first surface and the second surface of the sheet P are synchronously scanned by the reading section 106 for the first time, and then the flow proceeds to Act 5. In the first scanning, the read image is stored in the storage section 210.

In Act 5, the sheet P not subjected to a color erasing processing is guided to the second conveyance path 120 if the first reverse gate 126 is set to be ON, and then the flow proceeds to Act 6.

In Act 6, the first surface and the second surface of the sheet P are synchronously heated by the color erasing section 108 to carry out a color erasing processing, and then the flow proceeds to Act 7. In Act 7, a mark M printed on a margin W is subjected to a color erasing processing with the image.

In Act 7, the sheet P subjected to the color erasing processing is conveyed to the first path 114 again, and then the flow proceeds to Act 8.

In Act 8, a second scanning is carried out by the reading section 106, and then the flow proceeds to Act 9. In Act 8, the color-erased marks on the first surface and the second surface are read.

In Act 9, the processor 221 calculates the color difference $\Delta E1$ of the first surface, the color difference $\Delta E2$ of the second surface and the sum of the color differences $\Delta E1$ and $\Delta E2$, that is, a total color difference $\Delta E$, and then the flow proceeds to Act 10.

In Act 10, the total color difference $\Delta E$ is compared with the sheet using limit color difference e. Here, if the total color difference $\Delta E$ is below the sheet using limit color difference e, then the sheet may be reused as the reuse times of the sheet is not reached, and consequentially, the flow proceeds to Act 11. Further, if the total color difference $\Delta E$ exceeds the sheet using limit color difference e, then the reuse times of the sheet is reached, as a result, the flow proceeds to Act 15 in which paper is fed to the reject tray 112.

In the embodiment, the sheet P determined to be reusable according to color difference, in Act 11, is further directly determined that whether or not on which a color erasing processing is carried out well based on whether or not there is an image residual left. It may be also set that the sheet P is fed to the reuse tray 110 with saving the Act 11, however, words recorded with a color inerasable pen or an image residual left from a color erasing processing may exist on the sheet P. Therefore, whether or not there is an image residual left is determined in Act 11. If it is determined an excellent color erasing processing is carried out, then the flow proceeds to Act 12, otherwise, the flow proceeds to Act 15.

In Act 12, the first reverse gate 126 is set to be OFF so that the sheet P on the first path 114 is conveyed towards the second reverse gate 128, and then the flow proceeds to Act 13.

In Act 13, the second reverse gate 128 is set to be ON so that a reusable sheet P is housed in the reuse tray 110 (Act 14), and then the operation is ended.

On the other hand, if the color-erased sheet P is determined to be non-reusable in Act 10 or Act 11, then the first reverse gate 126 is set to be OFF in Act 15 so that the sheet P on the first path 114 is conveyed towards the second reverse gate 128, and then the flow proceeds to Act 16.

In Act 16, the second reverse gate 128 is set to be OFF so that the sheet P is housed in the reject tray 112 (Act 17), and then the operation is ended.

In the embodiment, marks M are overprinted during the images formation, the sheet use limit times is indirectly obtained based on the color difference of the marks M but not directly obtained by counting printing times. Thus, when an image is formed by the image forming apparatus, the marking apparatus for printing a mark M on the margin W of a sheet has no need to count the marking times of existing marks M. Although the marking apparatus uses the image formation process unit of the image forming apparatus 1, the marking apparatus may be arranged separated from the image formation process unit.

(Embodiment 2)

In embodiment 1, the reuse times of a sheet is indirectly obtained based on the color difference of marks M, especially based on the relationship between the total color difference of the marks which are overprinted at the same positions and a use limit times.

On the other hand, in order to obtain the use times of a sheet, marks are marked with color inerasable ink on the margin of a sheet at specific intervals so that the use times of the sheet can be directly counted if the marks are counted using the reading section 106. However, in this case, the number of the visual printed marks is increased with the increase in the reuse times of the sheet.

Figure 8:
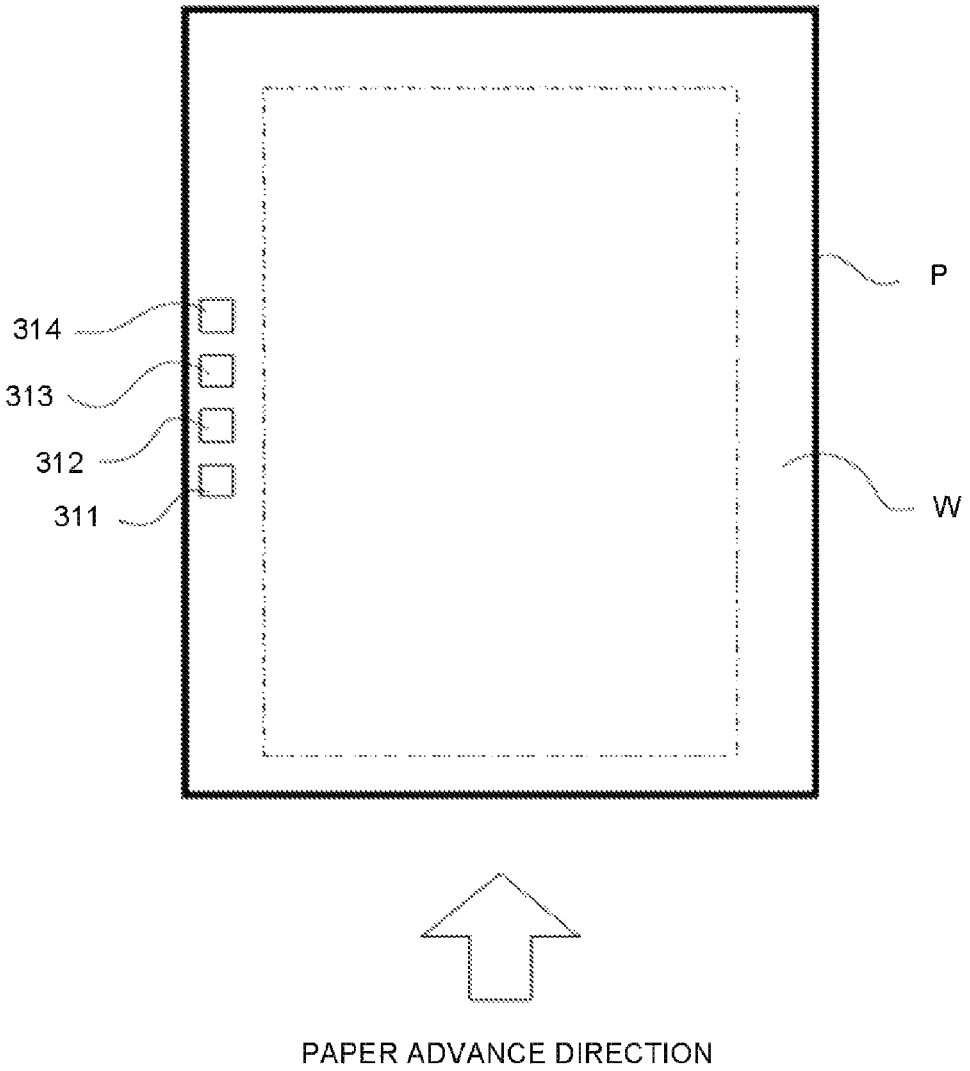
FIG. 8 is a diagram illustrating the print position of a mark according to embodiment 2.

In this embodiment, as shown in FIG. 8, a reuse mark is printed on the margin W of a sheet P with a color erasable material every time the sheet is reused. In FIG. 8, reuse marks 311, 312, 313 and 314 are printed at proper intervals. The reuse mark 311 represents the first times of reuse, and the marks 312, 313 and 314 represent the second, the third and the fourth times of reuse, respectively. Here, the colors of the reuse marks 311, 312, 313 and 314 are erased if the color erasing apparatus 100 shown in FIG. 4 carries out a color erasing processing for the reuse marks, and color differences can be detected then. Moreover, the color differences of the color-erased reuse marks 311, 312, 313 and 314 become substantially equal values. Thus, when an image is formed on the reusable sheet housed in the reuse tray 110 and then color-erased by the color erasing apparatus 100 shown in FIG. 4, a determination on whether or not the reuse marks 311, 312, 313 and 314 exist can be made according to the color differences based on the image read by the reading section 106. The marking apparatus 300 for printing the reuse marks 311, 312, 313 and 314 can be located between the bifurcating point 122 and the reading section 106 in the color erasing apparatus shown in FIG. 4. Further, the marking apparatus 300 may be a marking apparatus of inkjet type.

In this case, reuse marks are detected based on color differences during a first scanning, and a reuse mark is printed at a third position by the marking apparatus 300 if two reuse marks are detected. As the reuse marks are printed during the first scanning, the sheet printed with reuse marks at the third time is conveyed to the second conveyance path 120 and then color-erased by the color erasing section 108. Further, if it is detected during the first scanning that the using limit, for example, fifth times, of the sheet is reached, then the sheet is conveyed to the reject tray 112 but not guided to the second conveyance path 120. Further, as no reuse mark is printed during the first color erasing processing, a first time reuse mark is printed at a specific position.

In this way, even if reuse marks are printed, the reuse marks printed in the margin area W of a reusable sheet housed in the reuse tray 110 cannot be detected by visual observation as the colors of the reuse marks are subjected to a color erasing processing with the color erasing section 108 later. Thus, no printed reuse marks will be found on the margin of the sheet on which an image is formed by the image forming apparatus, and it will not become an eyesore.

Figure 4:
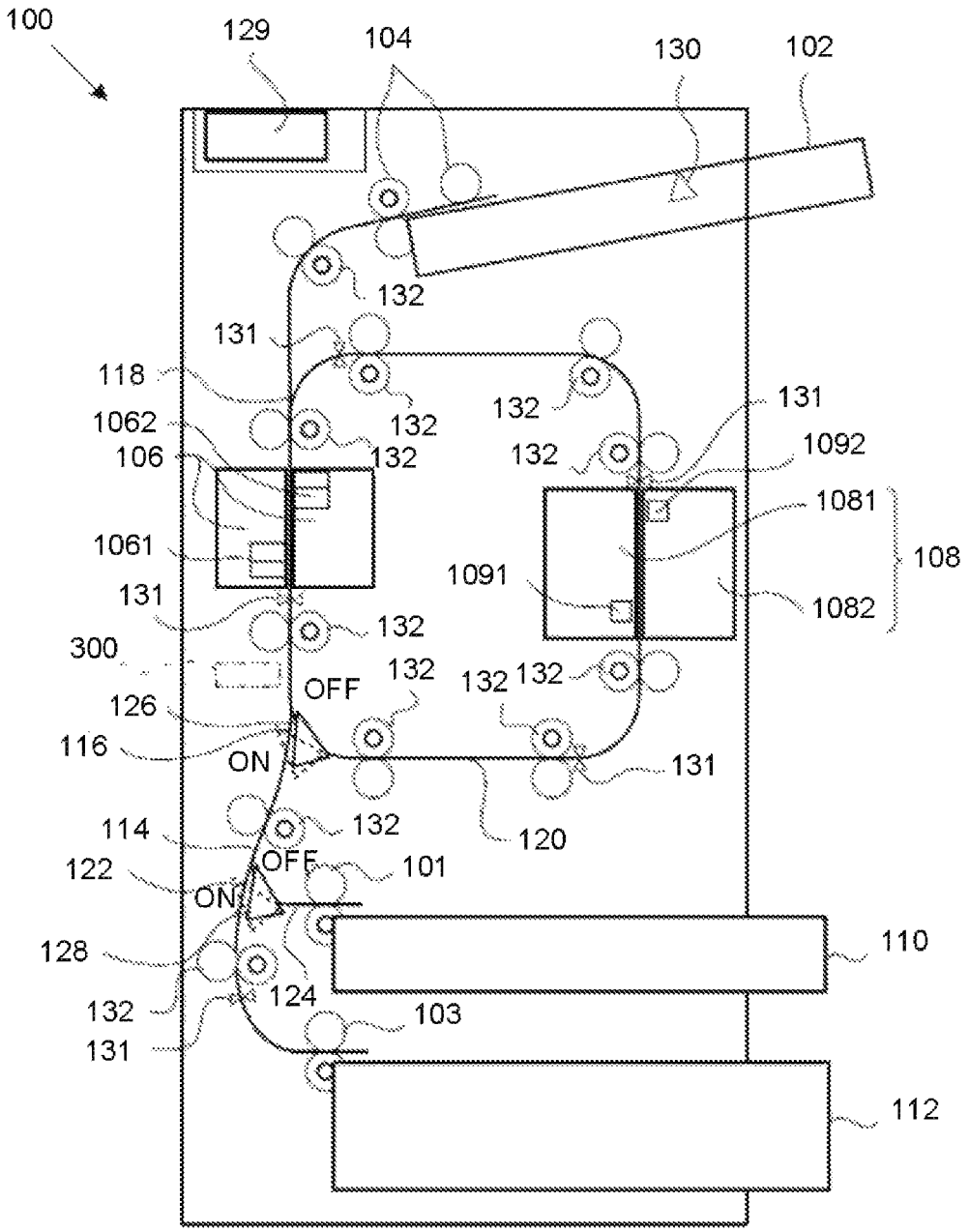
FIG. 4 is a schematic diagram illustrating a color erasing apparatus for erasing the color of a sheet printed by the image forming apparatus shown in FIG. 1.

The execution of the programs pre-stored in the storage areas set in the image forming apparatus and the color erasing apparatus in an internal data processor is illustrated in the processing described in FIG. 1 and FIG. 4, however, the same programs may be downloaded to the MFP from a network and stored in a computer-readable recording medium which is then installed in an MFP. The recording medium may be any computer-readable recording medium that is capable of storing programs, such as a RAM (Random Access Memory), a ROM (Read Only Memory), a DRAM, a SRAM (Static Random Access Memory), a VRAM (Video RAM) and a flash memory.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A marking apparatus, comprising:

a reading section configured to read an image including a first mark on a sheet, the first mark being formed with a color erasable material in the margin area of the sheet to indicate used times of the sheet;

a storing section configured to store the read image data by the reading section;

a judging section configured to judge the reuse times of the sheet based on the read first mark;

a marking section configured to form a second mark in the margin area of the sheet with a color erasable material to indicate the used times of the sheet is increased based on the judged result of the judging section; and an erasing section configured to erase the image including at least the first mark on the sheet.

2. The marking apparatus according to claim 1, wherein the erasing section erases the image including the first mark and the second mark.

3. The marking apparatus according to claim 1, wherein the judging section judges the reuse times of the sheet based on a color difference.

4. The marking apparatus according to claim 3, wherein the color difference is the color difference between an image of erasing residual left of the first mark and a ground color of the sheet.

5. The marking apparatus according to claim 1, further comprising:

a reject tray configured to stack a sheet which is judged that the reuse times reaches to a predetermined times.

6. A method provided for a marking apparatus, comprising:

reading an image including a first mark on a sheet, the first mark being formed with a color erasable material in the margin area of the sheet to indicate used times of the sheet;

storing the read image data by the reading section;

judging the reuse times of the sheet based on the read first mark;

forming a second mark in the margin area of the sheet with a color erasable material to indicate the used times of sheet is increased based on the judged result of the judging section; and erasing the image including at least the first mark on the sheet.

7. The method according to claim 6, wherein erasing the image including the first mark and the second mark.

8. The method according to claim 6, wherein judging the reuse times of the sheet based on a color difference.

9. The method according to claim 8, wherein the color difference is the color difference between an image of erasing residual left of the first mark and a ground color of the sheet.

10. The method according to claim 6, further comprising:

stacking a sheet which is judged that the reuse times reaches to a predetermined times to a reject tray.

* * * * *